US006094588A

United States Patent [19]

Adam

[11] Patent Number: 6,094,588

[45] Date of Patent: Jul. 25, 2000

[54] RAPIDLY TUNABLE, HIGH-TEMPERATURE SUPERCONDUCTOR, MICROWAVE FILTER APPARATUS AND METHOD AND RADAR RECEIVER EMPLOYING SUCH FILTER IN A SIMPLIFIED CONFIGURATION WITH FULL DYNAMIC RANGE

[75] Inventor: John D. Adam, Murrysville, Pa.

[73] Assignee: Northrop Grumman Corporation, Los Angeles, Calif.

[21] Appl. No.: 08/863,053

[22] Filed: May 23, 1997

[51] Int. Cl.[7] ..... H01P 1/203; H01B 12/02

[52] U.S. Cl. ..... 505/210; 505/700; 505/701; 505/866; 333/205; 333/219.2; 333/99.005; 342/98

[58] Field of Search ..... 333/205, 219.2, 333/995; 505/210, 700, 701, 866; 342/98

[56] References Cited

U.S. PATENT DOCUMENTS

| | | | |
|---|---|---|---|
| 4,020,429 | 4/1977 | Bickley | 333/205 |
| 4,418,324 | 11/1983 | Higgins et al. | 333/205 X |
| 4,853,660 | 8/1989 | Schloemann | 333/205 X |
| 5,106,826 | 4/1992 | Alford et al. | 505/700 X |
| 5,484,765 | 1/1996 | Dionne et al. | 333/995 X |
| 5,770,546 | 6/1998 | Grothe et al. | 333/995 X |

OTHER PUBLICATIONS

Jaroslaw Uher et al., "Tunable Microwave and Millimeter–Wave Bandpass Filters," IEEE Transactions on MTT, vol. 39, pp. 643–653, 1991.

J.W. Simone et al., "A Reciprocal TEM Latching Ferrite Phase Shifter", International Microwave Symposium Digest, pp. 241–246, 1996.

Gerald F. Dionne et al., "Low–Loss Microwave Ferrite Phase Shifters With Superconducting Circuits", IEEE MMT–S Digest, pp. 101–103, 1994.

Gordon R. Harrison et al., Ferrimagnetic Parts for Microwave Integrated Circuits, IEEE Trans MTT–19, pp. 577–588, 1971.

El–Badawy El–Sharawy et al, "Dual–Ferrite Slot Line for Broadband, High– Nonreciprocity Phase Shifters", IEEE Transactions on Microwave Theory and Techniques, vol. 39, No. 12, Dec. 1991.

Tsutsmi M. et al; "Magnetically Tunable Superconducting Filters Using Yttrium Iron Garnet Films"; *IEEE Trans on Magnetics*; vol. 31, No. 6; Nov. 1995; pp. 3467–3469.

Totel, A et al; "Magnetically Tunable $YB_aCO$ microstrip resonators and band pass filters"; *Appl. Phys. Lett*; vol. 68, No. 18; Apr. 29, 1996; pp. 2559–2561.

*Primary Examiner*—Benny T. Lee

[57] ABSTRACT

A narrow bandwidth (1 to >100 MHz) HTS microwave filter (30 or 50) is described which is tunable over a moderate frequency range (100 to >1000 MHz at X-band). The low loss (<1 dB) and GHz/microsecond tuning rates enable the filter to operate as a radar preselector filter. The filter consists of a multi-pole microstrip or stripline HTS coupled one-half resonator pattern deposited onto a ferrite substrate (32 or 52, 54). The ferrite substrate is operated in a latching mode like that in the operation of digital phase shifters. The filter tunability arises from the variation of the effective permeability with the remanent magnetization.

5 Claims, 6 Drawing Sheets

FIG. 2
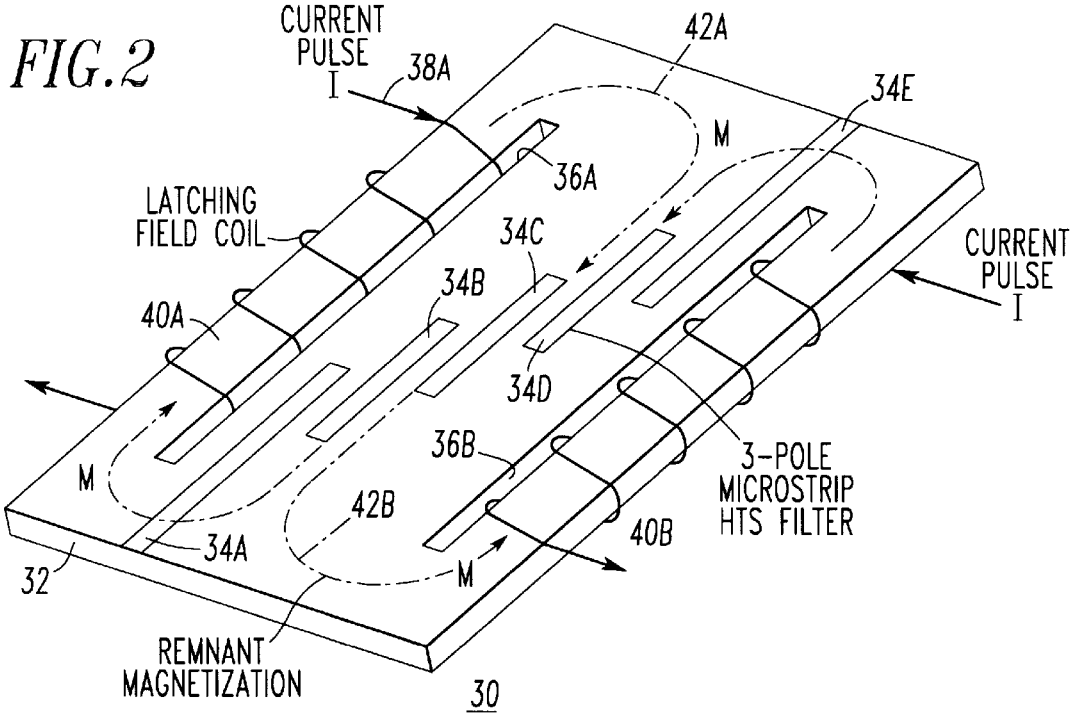
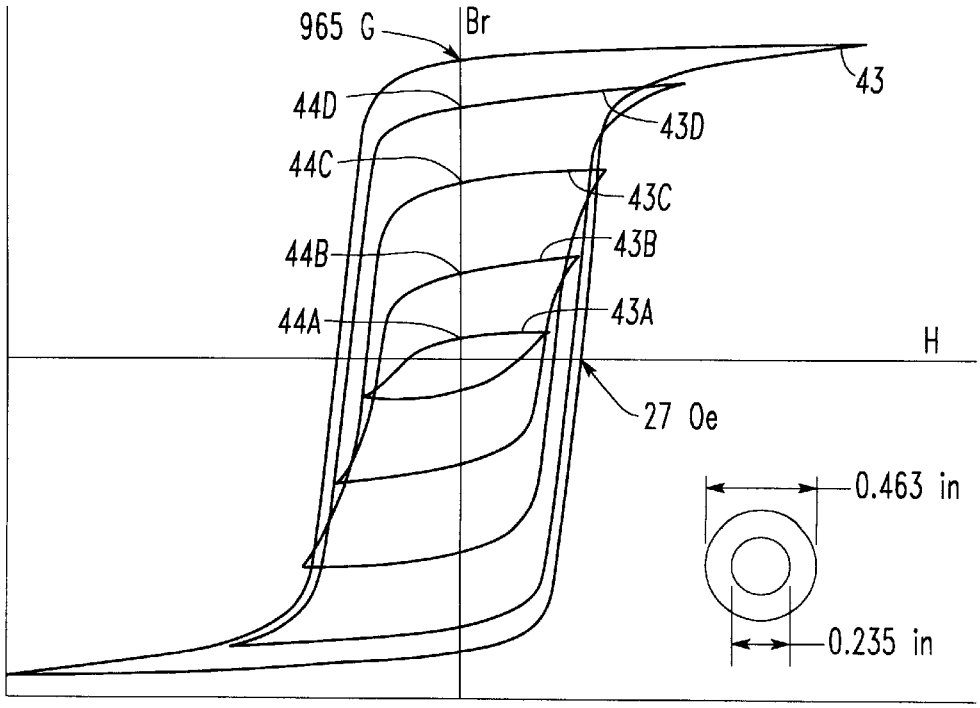
FIG. 3

FIG. 8A
PRIOR ART
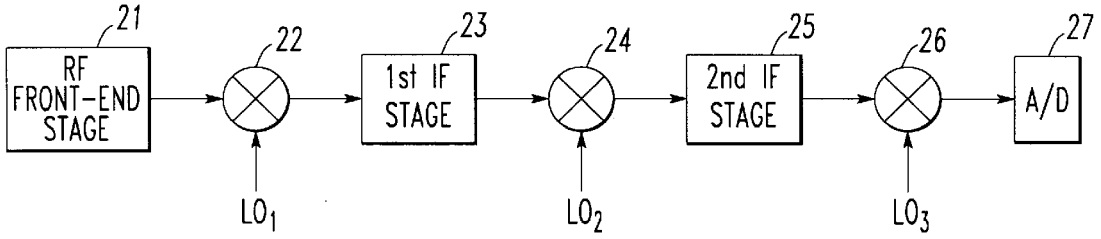
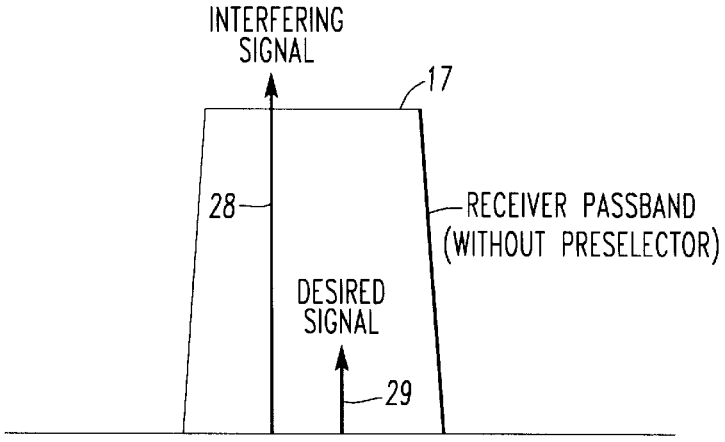
FIG. 8B
PRIOR ART

RAPIDLY TUNABLE, HIGH-TEMPERATURE SUPERCONDUCTOR, MICROWAVE FILTER APPARATUS AND METHOD AND RADAR RECEIVER EMPLOYING SUCH FILTER IN A SIMPLIFIED CONFIGURATION WITH FULL DYNAMIC RANGE

BACKGROUND OF THE INVENTION

The present invention relates to tunable microwave filter apparatus and methods and, more particularly, to such apparatus and methods employing high temperature superconductors (HTS) and to radar receivers employing such filters.

In radar applications, preselector filtering is desirable to achieve full dynamic radar range in the presence of a multi-signal environment. Switched filter-banks have been under development for this purpose.

Conventional filter banks are unable to provide the narrow, (>100 MHz) bandwidth required in a compact, cost effective manner. Superconducting filter bands which can achieve less than 100 MHz bandwidths have been demonstrated. However, this filter technology requires a complex and bulky cryogenic module, since a large number of megahertz channels (i.e., 50×20 MHz channels) are required to cover a 1 GHz bandwidth. GaAs switches provide switching, but cause most of a 1 dB loss in these banks and further generate much of the heat which requires cryogenic cooling.

Tunable bandpass filters, which trace the frequency of a hopping or scanning radar signal, could significantly reduce the size, complexity, and power losses associated with switched-bank preselector filters. Various technologies have been employed in designing tunable bandpass filters for microwave applications, but all such known filters have disadvantages associated with them.

For example, tunable YIG filters employ magnetic field tuning. However, these filters are slow in tuning, require a continuous current to supply the magnetic bias field resulting in significant power dissipation, and cannot handle higher power levels (i.e., restricted to about 100 milliwatts or less).

Mechanical filters employ tunable waveguide structure with mechanical element motion needed for tuning. Such filters are bulky and inherently tune slowly.

Varactors employ reverse biased diodes to provide fast tuning, but operate with nonlinearity and cannot handle power above about 1 milliwatt.

Ferroelectric filters provide tuning by using electric field control to vary the dielectric constant characteristic of the filter. Ferroelectric filters tune rapidly, but operate nonlinearly and cannot handle power above about 1 milliwatt.

For further information on tunable microwave filters, reference is made to TUNABLE MICROWAVE AND MILLIMETER-WAVE BAND-PASS FILTERS, Jaroslaw Uher and Wolfgang J. R. Hoefer, IEEE Transactions on MTT, Volume 39, Pages 643–653, 1991.

In summary, the known prior art tunable microwave filters lack the combination of rapid (microsecond) tuning, narrow band-pass, low insertion loss, and good linearity needed for efficient radar preselector filtering and similar microwave applications. In turn, radar receivers have essentially been restricted in dynamic range performance due to the unavailability of needed, practical preselector filters.

SUMMARY OF THE INVENTION

The present invention is directed to an HTS tunable microwave filter which functions with low insertion loss, narrow band-pass, and rapid tuning over a wide bandwidth, and to a radar receiver system which employs a preselector filter stage employing such HTS tunable microwave filter to have a simplified, less costly, and more reliable configuration and to operate with full dynamic range.

In accordance with the invention, a planar, tunable microwave filter is especially useful when operated in a radar apparatus and comprises an elongated ferrite substrate structure with a plurality of elongated high-temperature superconductor (HTS) strips secured to the ferrite substrate structure and extending longitudinally thereof in spaced relation to each other.

Two of the HTS strips are respectively disposed for input and output connections, and a latching field coil structure is coupled to the ferrite substrate structure, operates to carry an electric current pulse, and generates magnetic flux in the ferrite substrate structure along magnetic circuitry which extends along the HTS strips and within the field coil structure. The frequency to which the filter is tuned is determined by the permeability of the ferrite substrate as controlled by the amplitude of the current pulse.

BRIEF DESCRIPTION OF THE DRAWINGS

The accompanying drawings, which are incorporated in and constitute a part of this specification, illustrate a preferred embodiment of the invention and together with the description provide an explanation of the objects, advantages and principles of the invention. In the drawings:

FIG. 2 is a perspective view of a first embodiment of a tunable, HTS microstrip-ferrite, microwave filter structured in accordance with the invention and usable in the radar receiver system of FIG. 1;

FIG. 3 is a graph illustrating a B-H characteristic applicable to the filter of FIG. 2;

FIG. 8A is a block diagram of a typical prior art radar receiver system; and FIG. 8B illustrates a band-pass characteristic shown in the prior art radar receiver system of FIG. 8A.

DETAIL DESCRIPTION OF THE INVENTION

In accordance with the invention, a tunable microwave filter is embodied, with HTS-ferrite structure to provide sharp resonant frequency selectivity (high Q) with a rapid, GHz/microsecond tuning rate. Previous technology cannot achieve this level of performance. A radar receiver system practically employs the tunable filter of this invention as a preselector filter in a simplified configuration with better performance and full dynamic range.

Figure 1A:
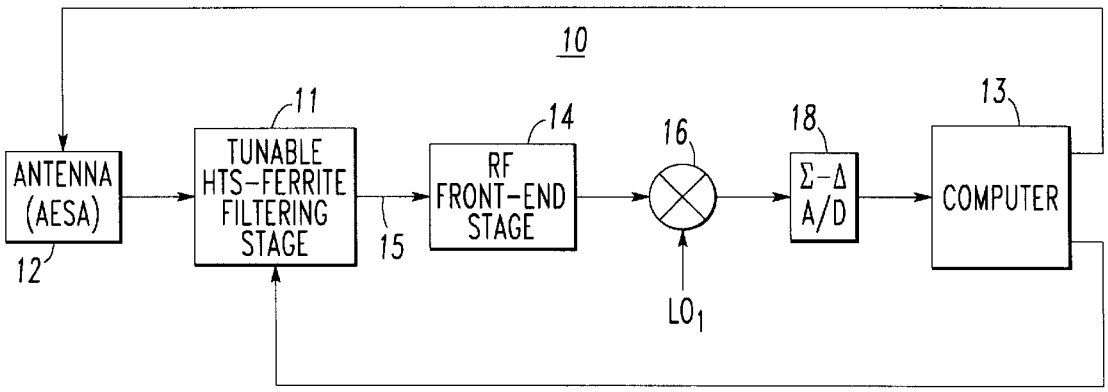
FIG. 1A is a block diagram of a radar receiver system structured with a simplified, less costly, configuration to provide, practically, more reliable operation with full dynamic range in accordance with the invention.
Figure 1B:
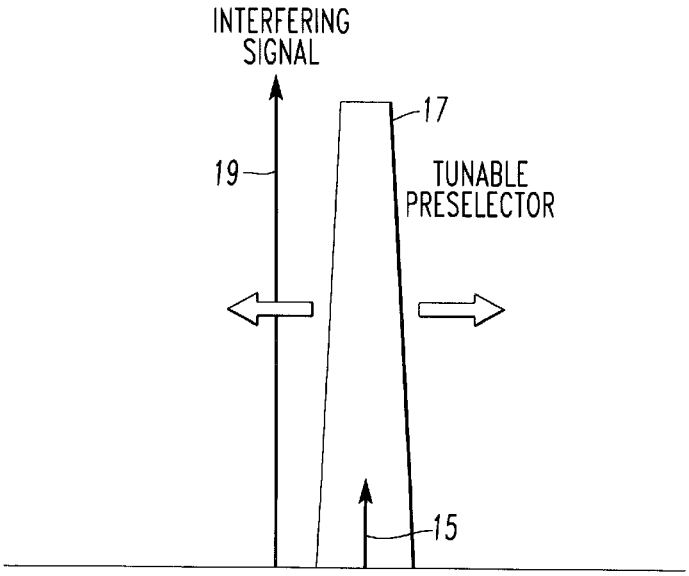
FIG. 1B illustrates the band-pass characteristic of the system of FIG. 1A.

As shown in FIG. 1A, a radar receiver system 10 of the subject invention includes a preselector filter stage 11 which employs a tunable HRS-ferrite filter. The preselector filter stage 11 passes microwave signals shown by reference numeral 15 (FIG. 1B) which are received from an antenna 12 (active electronic scanner array or AESA) and have frequencies within a narrow resonance frequency band 17 (FIG. 18) to which the filter is set by a radar computer 13. Reference numeral 19 indicates an undesirable interfering signal outside of the resonance frequency level 17. The AESA antenna 12 is also operated by the computer 13. The filter is frequency-tuned at a rapid rate, i.e., at a GHz/microsecond rate over the full frequency range of the radar receiver 10, thereby enabling rapid scanning or frequency hopping operation.

A front-end RF stage 14 amplifies the filtered microwave signals 15 and applies there signals preferably to a single downconverting stage 16 where it is mixed with a LO signal $LO_1$. Next, a converter 18 converts the downconverted signal from analog to digital form for processing by the computer 13.

A conventional radar receiver 20 is shown in FIG. 8A. In the absence of a preselector, HTS-ferrite filtering stage, the radar receiver 20 employs an RF front end stage and three downconverting mixer stages 22, 24, and 26 separated by two IF amplifier stages 23 and 25 and respectively employing mixing signals $LO_1$, $LO_2$, and $LO_3$ with the output applied to an analog to digital convertor (A/D) 27. As shown in FIG. 8B, the conventional radar receiver operates with a wider pass-band characteristic 17, which, because of its width, is more likely to contain an interfering signal 28 with the desired signal 29 as compared to the radar receiver system 10 of the invention. As shown in FIG. 1 the interfering signal 19 is outside the band 17 of the invention.

A tunable three-pole filter 30 of the invention is shown in FIG. 2. The filter 30 has a microstrip structure based on the application of HTS stripline filter techniques to low cost, planar ferrite structures. The tunable filter 30 is characterized with the attributes of microsecond tuning speed, narrow pass bandwidth, and low insertion loss which are needed in combination to enable preselector filter operation and provide the described performance for the radar receiver system 10. In addition, the filter 30 only dissipates energy during changes in frequency.

Figure 4:
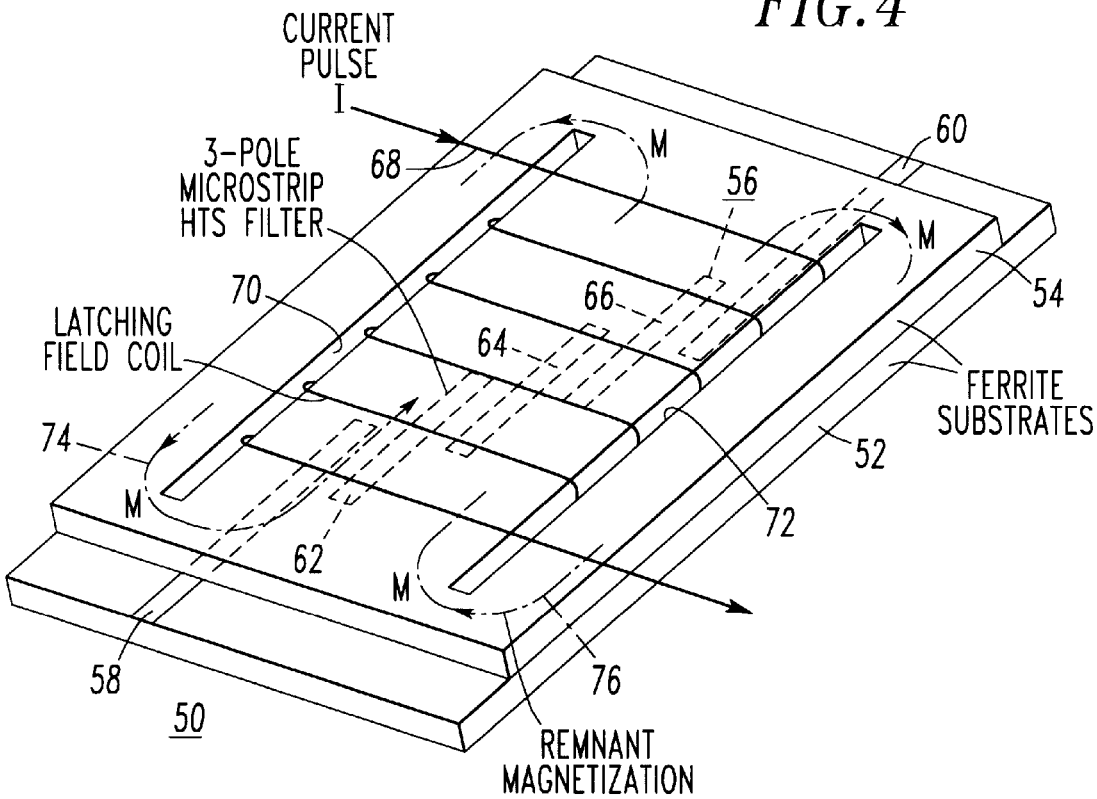
FIG. 4 is a perspective view of second embodiment of a tunable, HTS stripline-ferrite, microwave filter structured in accordance with the invention and usable in the radar receiver system of FIG. 1.

As shown in FIG. 4, a tunable filter 50 is a stripline version of the invention. The filter 50 is generally similar to the filter 30, and has the attributes needed for radar preselector filtering.

Both filters 30 and 50 employ a miltipole planar filter structure formed in an HTS film deposited on a ferrite substrate. Further, the ferrite substrate is structured to form a closed magnetic circuit which can be magnetized by a field pulse generated in a coil coupled to the magnetic circuit. The magnetization is substantially completely contained within the ferrite substrate to avoid exposure of the HTS to high magnetic fields which would degrade the HTS surface resistance.

The three-pole filter 30 (FIG. 2) has an elongated substrate 32 made from a ferrite such as lithium ferrite. Five elongated HTS strips 34A, 34B, 34C, 34D and 34E, each of predetermined length, are disposed on the substrate 32 to extend in the longitudinal direction and in spaced relation to each other in the transverse direction. In this embodiment, the HTS strips 34A and 34E respectively function as input and output elements, and the HTS strips 34B-34D function as resonator-poles. The tunable filter 30 is thus characterized as a three-pole filter.

Elongated, longitudinally extending slots 36A and 36B are formed in the ferrite substrate 32. The respective slots 36A and 36B are disposed symmetrically outwardly of the HTS strips 34A and 34E.

Respective latching field coils pass through the slots 36A and 36B, and are wound about respective side legs 40A and 40B. When respective current pulses I are applied to the latching coils 38A and 38B, magnetic flux is created in respective magnetic circuits in the ferrite substrate 32. When the current pulses are terminated, remanent magnetization M remains in the magnetic circuits of the ferrite substrate as indicated by the reference characters 42A and 42B. As described more fully subsequently herein, filters of the invention are tuned as a function of substrate permeability which, in turn, is determined by applied current pulse amplitude.

Overall, in applying the invention, a tunable filter is structured in accordance with a combination of HTS stripline filter principles with planar ferrite phase shifter principles to obtain microwave frequency tuning by means of ferrite permeability control.

The tunable filter 50 of FIG. 4 is a three-pole stripline ferrite (HTS) structure which operates in a manner similar to that described for the tunable microstrip filter 30. Thus, the filter 50 includes a lower elongated ferrite substrate 52 and an upper elongated ferrite substrate 54 with a three-pole stripline HTS filter strip structure 56 including pole strips 62, 64, and 66 (like the three-pole filter 34A–34E) disposed therebetween The upper substrate 54 is shorter than the lower substrate 52 to provide contact access for input and output strips 58 and 60 of the filter strip structure 56. A single latching coil 68 is wound about the filter strip structure 56 through slots 70 and 72 in the substrates 52 and 54. Magnetic circuits 74 and 76 carry magnetic flux created by current pulses I in the coil 68. Permanent magnetization remains in the substrate structure when a current pulse I ends.

FIG. 3 illustrates a B-H produced with a magnetic ring coil (flex density-magnetic intensity) having an inner diameter of 0.235 in. and an outer diameter of 0.463 in. and characteristic applicable to the latching coils 38A and 38B and the ferrite substrate 32 of FIG. 2 or the latching coil 68 and the substrate structure 52 and 54 of FIG. 4. With increases in the amplitude of the current pulses and the resultant magnetic intensity H, increasingly larger, minor B-H loops are created, and correspondingly larger remanent magnetizations are created in the ferrite substrate when the respective current pulses terminate. The largest B-H loop in FIG. 3 has remnant flux density of 965 Gauss with a magnetic intensity of 27 Oersteds.

Four minor B-H loops 43A, 43B, 43C, and 43D are illustrated in FIG. 3 with respective remanent magnetizations 44A, 44B, 44C, and 44D. Generally, the remanent magnetization B varies continuously over a range of minor B-H loops according to amplitudes of successive applied field pulses H.

As indicated in "A Reciprocal TEM Latching Ferrite Phase Shifter", published by J. W. Simon, W. K. Alverson, and J. E. Pippin, International Microwave Symposium Digest, pp. 241–246, 1996, the real part of the effective permeability $\mu_{eff}$ is given by:

$$\mu_{eff}=1-(\gamma 4nM_r)^2/(\omega^2+(\gamma\Delta H)^2/4$$

where $M_r$ is the remanent magnetization, $\gamma$ is the gryomagnetic ratio and $\Delta H$ is the linewidth. The change in phase for a signal traveling in a transmission line filled with a magnetized ferrite, relative to the unmagnetized case is:

$$\Delta\gamma=(\beta_u-\beta_r)L=360\epsilon_r^{1/2}(1-\mu_{eff}^{1/2})L/\lambda_o$$

where $\beta_u$ and $\beta_r$ are the propagation constants in the unmagnetized and remanently magnetized ferrite respectively, L is the length of the transmission line on the magnetized ferrite and $\lambda_o$ is the free space wavelength.

Figure 6:
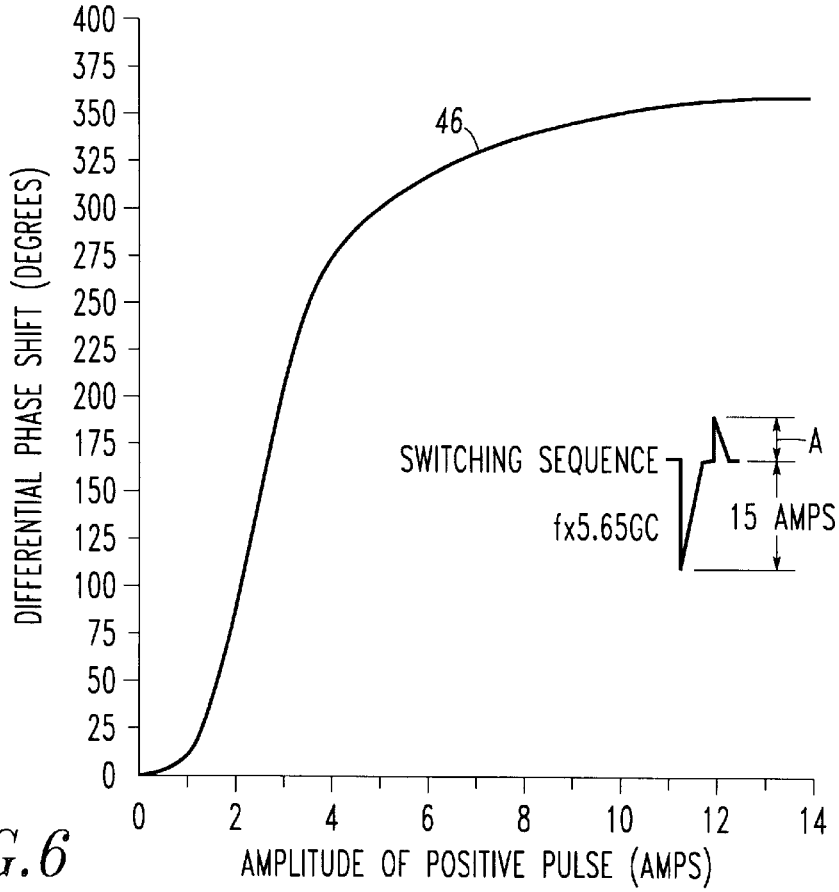
FIG. 6 is a phase shift characteristic representative of microwave phase shifting produced by a planar ferrite phase shifter.

A typical plot 46 of differential phase shift as a function of current pulse amplitude is shown in FIG. 6. A current pulse is only required to set the remanent magnetization to a new value. In a phase shifter application of microchip ferrite devices, the differential phase shift versus current phase amplitude characteristics are stored in a ROM so that the correct current pulse amplitude is applied to produce the desired phase shift. For more information on this subject, reference is made to U.S. Pat. No. 5,774,025, issued Jun. 30, 1998, entitled PLANAR PHASE SHIFTERS USING LOW COERCIVE FORCE AND FAST SWITCHING, MULTI-LAYERABLE FERRITE, filed by John Adam et al, on Aug. 8, 1995, and hereby incorporated by reference.

The microstrip or stripline resonator elements comprising the filter shown in FIG. 2 (and FIG. 4) are $\lambda_{eff}/2$ long, where $\lambda_{eff}$ depends on the effective permeability and permitivity of the ferrite. Differential phase shift of 90°/inch has been reported at 5.5 GHz (reference Simon et al. article), which translates into 30°/$\lambda/2$ at 10 GHz in a ferrite with an $\epsilon_r$=10. This change in phase produces a change in the resonant frequency of the filter resonators, as follows:

$$\Delta f_o=f_o\times\Delta\Phi/180$$

At 10 GHz, this corresponds to 1.67 GHz for a phase change of $\Delta\Phi$=30°. Thus, a bandpass filter of the invention with $\lambda/2$ resonators can be tuned over this frequency range. In the design of tunable filters of the invention, the coupling coefficients, both input/output and inter-resonator should be optimized to allow maintenance of the passband shape over the tuning range as will be understood by reference to "Tunable Microwave and Millimeter-Wave Band-Pass Filters", Jaroslaw Uher and Wolfgang J. R. Hoefer, IEEE Transactions on MTT, Vol. 39, pp. 643–53, 1991. A wider tuning range can be achieved through use of $\lambda$ or $3\lambda/2$ resonator elements.

Figure 5A:
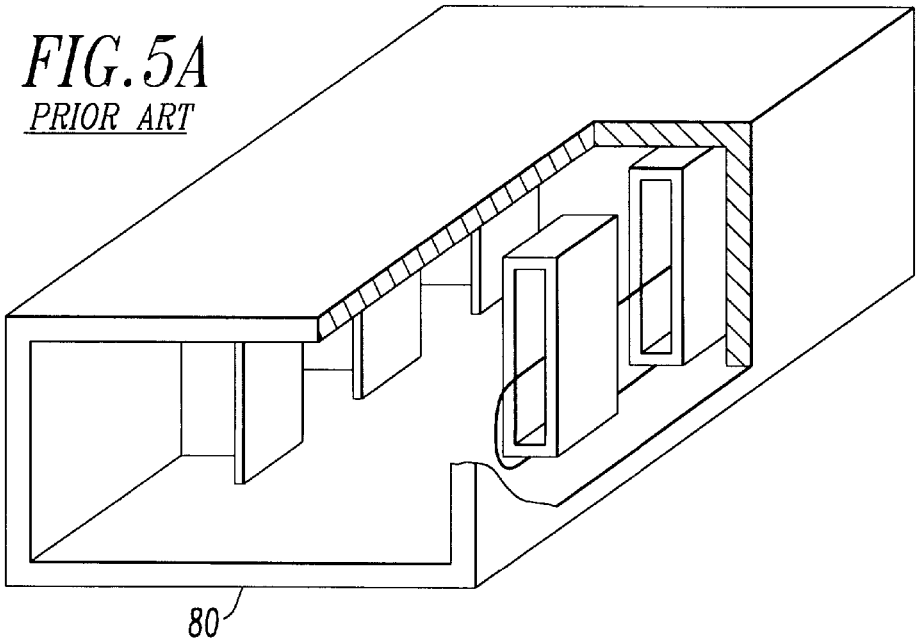
FIG. 5A PRIOR ART
FIG. 5A shows a prior-art, tunable E-Plane band-pass filter.
Figure 5B:
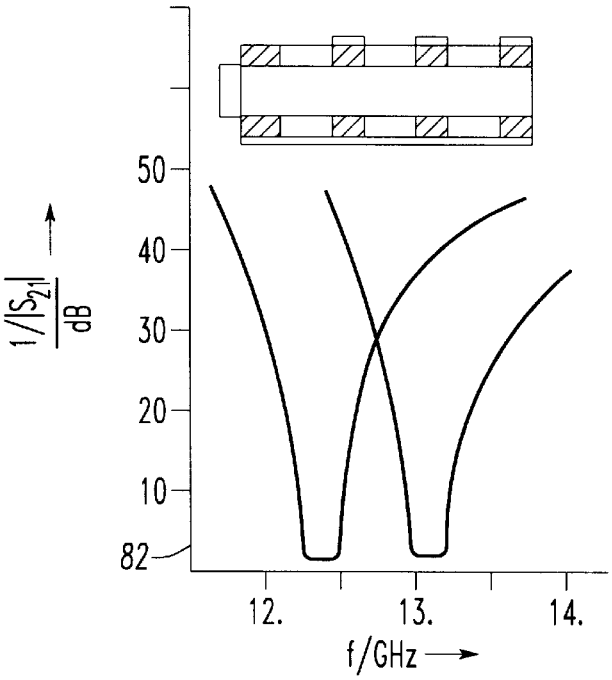
FIG. 5B PRIOR ART
FIG. 5B is illustrative of the tuning characteristic for the prior art filter of FIG. 5A.

The described tuning mechanism of the invention has been demonstrated previously in mm-wave E-plane filters (see Uher et al. article for more detail). An example of such a fast tuning E-plane bandpass filter 80 using ferrite toroids is shown in FIG. 5A with application of pulses IDC. As indicated by graph 82 in FIG. 5B which plots $1/|S_{21}|$/dB against f/$GH_z$, close to 1 GHz tuning range can be obtained. Note respective curves denoted by different magnetic intensities H. However, significant reductions below the 250 MHz bandwidth and >1 dB loss shown here are limited by the conduction loss in the E-plane resonators. If HTS were assumed to be used in E-plane resonators, a higher Q could be obtained with lower loss and narrower bandwidth. However, planar structures of the invention are much more compact and producible.

A low loss microwave phase shifter described in "Low-Loss Microwave Ferrite Phase Shifters with Superconducing Circuit", Gerald F. Dionne, Daniel E. Oates and Donald H. Temme, 1994 IEEE MMT-S Digest, pp. 101–103, uses superconducting meander line circuits deposited onto single crystal YIG films to provide non-reciprocal phase shift. This paper demonstrated that the microwave loss of the superconductor is not affected by the magnetic fields associated with the ferrite since they are completely contained within it.

A reciprocal C-band phase shifter has also been described in "Ferrimagnetic Parts for Microwave Integrated Circuits", Gorden R. Harrison et al., III Trans MTT-19, pp. 577–577, 1971, uses parallel coupled microstrip resonators on a ferrite substrate. The objective here was to achieve a more compact phase shifter through use of the increased group delay in a filter structure. In this case, it is necessary for the filter bandwidth to exceed the desired phase shifter bandwidth. This article notes that the center frequency of the filter changed "slightly" with change in phase shift.

In demonstration of the present invention, half wave microstrip and stripline resonators with Qs in the range $10^4$ to $10^5$ have been realized. Thus, filters with loaded Qs in the range $10^3$ to $10^4$, i.e., bandwidths in the 10 MHz to 1 MHz are possible at X-band. Ceramic ferrites have magnetic and less tangent tan $\delta$ in the $10^{-3}$ to $10^{-4}$ range so that ferrite selection is preferably made carefully to avoid degradation in the filter loss. The magnetization of the ferrite should be as high as possible while avoiding low field losses, i.e., $4\pi M<f_{min}/\gamma$ where $f_{min}$ is the minimum tuning frequency. Low coercivity, square loop characteristics at 77K are needed with performance similar to that achieved with lithium ferrites at room temperature.

A minimum 10 MHz filter bandwidth requires both very low surface resistance HTS films and very low tan $\delta$ ferrite, which may necessitate the use of single crystal or high purity ceramic ferrites.

Figure 7A:
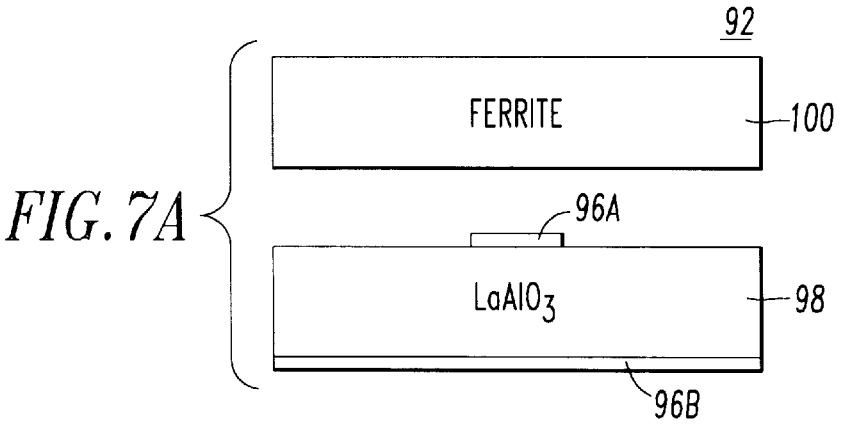
FIG. 7A is a schematic view of a first illustrative tunable microstrip configuration that can be used in embodying the invention.
Figure 7B:
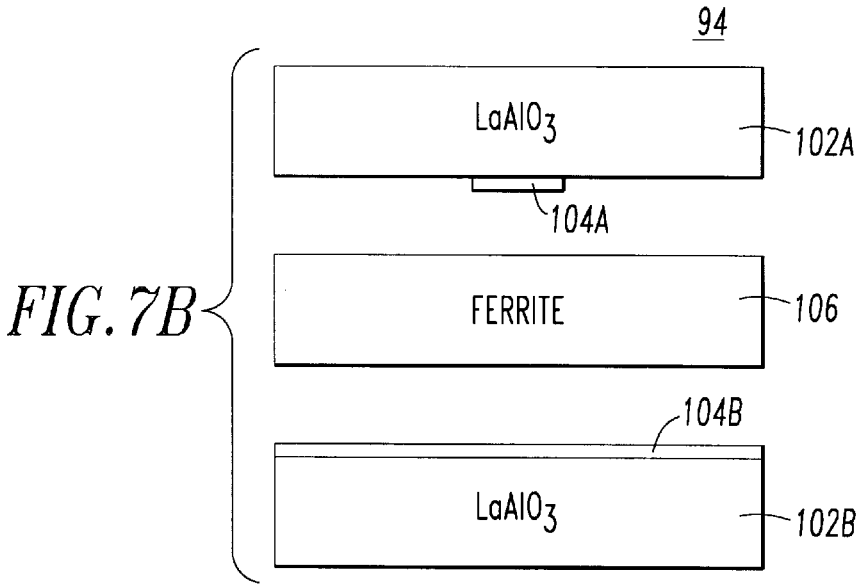
FIG. 7B is a schematic view of a second illustrative tunable microstrip configuration that can be used in embodying the invention.
Figure 7C:
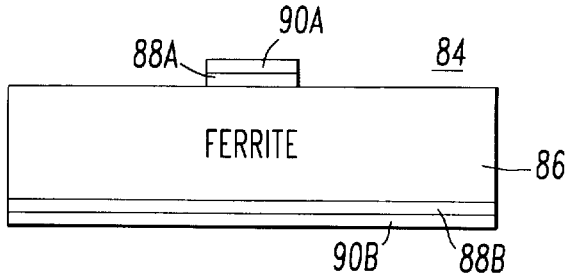
FIG. 7C is a schematic view of a third illustrative tunable microstrip configuration that can be used in embodying the invention.

Although the preferred structure comprises an HTS film of YBCO deposited directly on a ferrite structure with an appropriate buffer layer as indicated by structure 84 in FIG. 7C where reference numeral 86 denotes a ferrite substrate 88A and 88B denote intermediate buffer layers and 90A and 90B denote outer YBCO layers other configurations are possible. Alternative configurations 92 and 94 (FIGS. 7A, 7B) include slot-line and coplanar resonators as well as hybrids which may have the HTS resonators of YBCO film formed on a substrate of lanthanum aluminate or sapphire and which are placed in contact with a ferrite latching structure. In FIG. 7A, for example, YBCO films 96A and 96B are formed on an La $AlO_3$ substrate 98 over which is located a ferrite substrate 100, In FIG. 7B, upper and lower $L_aAlO_3$ substrates 102A and 103B have YBCO films 104A and 104B formed therein and are separate by a ferrite substrate 106.

The foregoing description of the preferred embodiment has been presented to illustrate the invention without intent to be exhaustive or to limit the invention to the form disclosed. In applying the invention, modifications and variations can be made by those skilled in the pertaining art without departing from the scope and spirit of the invention. It is intended that the scope of the invention be defined by the claims appended hereto, and their equivalents.

What is claimed is:

1. A radar apparatus comprising:

a antenna structure for transmitting and receiving radar signals;

a preselector filter stage coupled to the antenna structure;

a radio frequency amplifying and downconverting subsystem coupled to the preselector filter stage;

a computer system for controlling the operation of the antenna structure and for controlling the application of current pulses to the ferrite structure of the preselector filter state to provide latching control of the ferrite permeability with remanent magnetization and, thereby, to control a pass frequency of the preselector filter stage; and wherein the preselector filter stage includes a planar, tunable microwave filter including, an elongated stripline ferrite substrate structure having a predetermined length and including first and second ferrite layers;

a plurality of discrete elongated high-temperature superconductor (HTS) strips of predetermined length, disposed between said first and second ferrite layers, said strips being substantially parallel to each other and mutually staggered in a lengthwise direction along the length of the substrate structure;

two of the HTS strips being respectively disposed for input and output connections;

at least one of the ferrite layers being structured to provide connection access to the two HTS strips;

a latching field coil structure coupled to the ferrite substrate structure, being operable to carry the current pulses, thereby generating magnetic flux in the ferrite substrate structure along magnetic circuitry which extends along the HTS strips and within the field coil structure;

whereby the filter tunes the operation of the radar apparatus to the pass frequency which is determined by the permeability of the ferrite substrate structure with remanent magnetization as controlled by the amplitude of the current pulse.

2. A planar, tunable microwave filter comprising:

an elongated stripline ferrite substrate structure having a predetermined length and including first and second ferrite layers;

a plurality of discrete elongated high-temperature superconductor (HTS) strips of predetermined length disposed between said first and second ferrite layers and extending longitudinally thereof in transversely spaced relation to each other;

two of the HTS strips being respectively disposed for input and output connections;

at least one of the ferrite layers being structured to provide connection access to the two HTS strips;

wherein each one of the HTS strips has a respective length which is shorter than the length of the substrate structure, and the HTS strips are disposed in substantially parallel relation to each other, and are mutually staggered relative to each other in a lengthwise direction along the length of the substrate structure;

a latching field coil structure coupled to the ferrite substrate structure, being operable to carry an electric current pulse, thereby generating magnetic flux in the ferrite substrate structure along magnetic circuitry which extends along the plurality of HTS strips and within the field coil structure;

whereby the filter is tuned to a frequency which is determined by the permeability of the ferrite substrate with remanent magnetization as controlled by the amplitude of the current pulse.

3. The filter of claim 2 wherein:

a first of the two HTS strips operates as an input connection and extends from one end of the substrate structure and inwardly along the substrate structure;

a second of the two HTS strips operates as an output connection and extends from an inward location of the ferrite substrate structure to a second end of the substrate structure opposite the first end; and at least another of the HTS strips disposed between the first and second HTS strips to operate as a resonator pole.

4. The filter of claim 3 wherein said at least another of the HTS strips comprise three other HTS strips disposed between the first and second HTS strips to operate as three resonator poles.

5. A method for operating a tunable microwave filter having an elongated stripline ferrite substrate having a predetermined length and including first and second ferrite layers and having a plurality of discrete elongated high-temperature superconductor (HTS) strips disposed between the first and second ferrite layers, wherein the strips are substantially parallel to one another and mutually staggered in a lengthwise direction along the length of the substrate structure and where one of the ferrite layers is structured to provide connection access to the HTS strips, the method steps comprising:

generating an electric current pulse in a latching field coil structure coupled to the ferrite substrate structure to generate magnetic flux in the ferrite substrate structure along magnetic circuitry which extends along the HTS strips and within the field coil structure;

whereby the filter is tuned to a frequency which is determined by the permeability of the ferrite substrate with remanent magnetization as controlled by the amplitude of the current pulses.

* * * * *